United States Patent [19]

Abramsen

[11] 4,185,484

[45] Jan. 29, 1980

[54] PROCESS AND APPARATUS FOR FORMING COLD FINISHED BAR

[76] Inventor: Finn B. Abramsen, 4742 Baldwin Manor Rd., Pittsburgh, Pa. 15227

[21] Appl. No.: 951,599

[22] Filed: Oct. 16, 1978

Related U.S. Application Data

[63] Continuation-in-part of Ser. No. 810,948, Jun. 29, 1977, abandoned.

[51] Int. Cl.[2] ..... B21B 45/04

[52] U.S. Cl. ..... 72/40

[58] Field of Search ..... 29/81 R, 81 A, 81 F, 29/81 G, 81 H, 81 J; 72/39, 40, 45, 201, 366

[56] References Cited

U.S. PATENT DOCUMENTS

| | | | |
|---|---|---|---|
| 1,914,587 | 6/1933 | Wise | 72/40 |
| 2,163,699 | 6/1939 | Paul | 72/40 |
| 2,242,024 | 5/1941 | Dillon | 72/40 |
| 2,642,763 | 6/1953 | Abramsen | 72/40 |
| 3,081,524 | 3/1963 | Ballentine et al. | 72/40 |
| 3,250,102 | 5/1966 | Howeler | 72/40 |

FOREIGN PATENT DOCUMENTS

| | | | |
|---|---|---|---|
| 1168377 | 4/1964 | Fed. Rep. of Germany | 72/366 |
| 351610 | 10/1972 | U.S.S.R. | 72/40 |
| 388801 | 11/1973 | U.S.S.R. | 72/40 |
| 401089 | 6/1974 | U.S.S.R. | 72/40 |
| 481340 | 11/1975 | U.S.S.R. | 72/40 |

*Primary Examiner*—Ervin M. Combs

*Attorney, Agent, or Firm*—Stanley J. Price, Jr.; John M. Adams

[57] ABSTRACT

Hot rolled round stock is fed in a first stage through a pair of rotating work rolls having a rough, rugulose concave surface that frictionally engages the surface of the stock to deform the surface of the stock by the application of pressure thereto and thereby dislodge substantially all the mill scale therefrom. The engagement of the work rolls with the stock provides positive drive to the stock to rotate the stock so that the stock advances in a spiral course without skidding through the work rolls to a secondary scale remover that includes a descaling machine for removing the remaining scale from the surface of the stock. A plurality of blast units within a chamber of the descaling machine directs a stream of abrasive particles upon the entire surface of the stock to dislodge the remaining scale therefrom and form a bar free of scale. The bar is advanced in a third stage to a rolling mill that includes a plurality of cross-rolling units in a series arrangement. Each unit includes a pair of smooth work rolls that engage the surface of the bar to reduce the bar to a final dimension and finish for a subsequent treatment, such as coating or inspection for defects.

10 Claims, 4 Drawing Figures

PROCESS AND APPARATUS FOR FORMING COLD FINISHED BAR

CROSS-REFERENCE TO RELATED APPLICATION

This application is a continuation-in-part of copending application Ser. No. 810,948, entitled "Process And Apparatus for Forming Cold Finished Bar" and filed June 29, 1977, abandoned.

BACKGROUND OF THE INVENTION

1. Field of the Invention

This invention relates to a process and apparatus for forming cold finished bar from hot rolled round and more particularly to a process and apparatus for removing the mill scale from hot rolled round to form cold finished bar.

2. Description of the Prior Art

In the manufacture of steel products it is the practice to remove the mill scale from the surface of the steel by one operation and to perform the final size reduction and finishing by another operation. Mill scale may be removed either mechanically or chemically. Known mechanical processes include sandblasting, grinding and the like, as well as passing the workpiece through a descaling machine. A typical descaling machine is manufactured by Pangborn Corp. and is operable to remove mill scale from rod, sheets, billets, slabs and other steel products by feeding the item through a descaling chamber where abrasive streams of shot and/or grit are directed onto the entire surface area of the workpiece. The abrasive streams remove the scale from the surface of the steel. However, the steel must be fed through the scaling chamber at a relatively slow rate to ensure that all the mill scale is removed in a single pass so that it is not necessary to make more than one pass through the descaling chamber.

Chemically, mill scale is removed from the surface of steel stock by pickling with acid. The steel stock is immersed in an acid bath which chemically attacks the mill scale to remove it from the surface of the stock. This operation is time consuming and requires considerable floor space to accommodate the vessels for the acid bath. Furthermore, pickling is relatively expensive and presents problems in the disposal of the waste pickle liquor.

It is also known to reduce the diameter of bar stock by cold rolling or cold drawing to produce a cold rolled bar and a cold drawn bar respectively. With these operations the stock is reduced in diameter by redistributing the material of the bar in order to form a bar having a preselected size and smoothness of finish. However, prior to reducing the diameter of and sizing the round bar stock, the mill scale must be removed by one of the above mentioned operations. U.S. Pat. No. 2,642,763 discloses a cross rolling mill for reducing the diameter of and for sizing round bar stock. The cross rolling mill includes a pair of work rolls each having a concave work engaging surface that exerts a rolling force on the workpiece to reduce the diameter of the bar and shape the bar so that the bar is circular in cross section throughout its entire length and has a preselected surface finish. A backing roll supports each work roll. The backing rolls are rotatably supported and driven to exert a preselected pressure upon the work rolls to maintain the work rolls in contact with the stock to make the desired reduction of the stock.

U.S. Pat. No. 1,914,587 discloses a method of finishing rounds that includes passing the round through a longitudinally spaced series of cross rolls. The cross rolls are arranged in pairs and each pair includes an idler roller and a cooperating driven roller. The initial pair of cross rolls break the scale from the stock by pressure application, and the remaining cross rolls provide for rounding and polishing. The round is also passed through a steel blast for descaling.

U.S. Pat. No. 2,163,699 discloses a method and apparatus for rolling hot strip material that includes a roughing stand of work rolls and back-up rolls, a scale breaker of a pair of pressure rolls, and a finishing stand of work rolls and back-up rolls.

U.S. Pat. Nos. 2,242,024 and 3,081,524 disclose scale breaking apparatus for rods and wire by flexing and bending the stock to break the scale on the stock. The stock is also subjected to the scarifying action of toothed sheaves which scratch the scale from the stock.

Hot rolled round after fabrication is non-circular in cross section and by the forming and finishing process is reduced to a final preselected circular dimension. However, as the non-circular or elliptically shaped round is passed through the pressure rolls it has a tendency to skid through the rolls without rotating. Subsequently, flat spots are formed on the round and all the scale is not removed from the surface of the round if it is not uniformly rotated through the pressure rolls.

Therefore, there is need in the process of cold forming hot rolled round by pressure rolls to increase the efficiency of the work rolls to remove the scale from the round without encountering the problem of the roll skidding through the pass of the work rolls without rotating. In addition, there is need for a process and apparatus for efficiently combining the operations of removing mill scale from the surface of hot rolled round and reducing the round to form a cold finished bar in a manner that overcomes the disadvantages of separately carrying out the operations of mechanical and/or chemical descaling and finishing by cold rolling or cold drawing.

SUMMARY OF THE INVENTION

In accordance with the present invention there is provided apparatus for forming cold finished bar from hot rolled round that includes a primary scale remover for receiving the hot rolled round. The primary scale remover includes a cross-rolling unit having a first rotating member for frictionally engaging the surface of the round. The first rotating member has a portion with a rugulose surface operable to frictionally engage to the surface of the round to permit the application of sufficient pressure to the round to deform the round and thereby effectively remove a substantial portion of the scale from the surface of the round. The cross-rolling unit includes a second rotating member for maintaining the rugulose surface of the first rotating member in frictional engagement with the surface of the round to exert sufficient pressure upon the round to remove substantially all the scale from the surface of the round and to impart rotary motion to the round so that the round rotates along a spiral path as the round advances linearly through the primary scale remover.

Preferably the primary scale remover is a cross-rolling unit having a pair of work rolls each with a concave surface in which a portion thereof has a rough abrading or rugulose nature operable to frictionally engage the surface of the round as the round moves between the oppositely positioned work rolls. A pair of backing rolls exert a preselected pressure upon the work rolls so that the rugulose surfaces of the work rolls engage the surface of the round to deform the round and dislodge between 80% to 90% of the mill scale. The provision of the rugulose surfaces on the work rolls increases the engagement of the work rolls with the hot rolled round to be descaled to apply maximum pressure to the round. This transmits rotary motion to the round so that the round advances longitudinally along a spiral course between the work rolls. Thus, the round is prevented from skidding between the work rolls and continuously rotates to increase the percentage of scale removed by the primary scale remover.

A backing roll is maintained in contact with each work roll to apply pressure to the respective work roll to maintain the rugulose surface thereof in frictional engagement with the round. Each backing roll, however, includes a relief portion on the convex surface of the roll opposite the portion of the work roll having the rugulose surface. This arrangement removes the backing roll from contact with the rugulose surface so that the roughness of the rugulose surface is not reduced and the abrading affect of the rugulose surface on the round is maintained.

The secondary scale remover is a descaling machine that includes a sealed chamber housing a plurality of outlets from which abrasive streams of particles, such as steel shot and/or grit, are directed under pressure upon the surface of the round. The remaining scale on the round is uniformly removed by the affects of the abrasive streams as the round advances linearly in a spiral path through the descaling chamber. The third stage of the forming process is the finishing stage which preferably includes a plurality of cross-rolling units positioned in a series arrangement downstream of the descaling machine. Each of the cross-rolling units utilized in the third stage includes a pair of work rolls supported by larger diameter backing rolls. The work rolls of the third stage size the bar to a preselected diameter and smooth the bar to obtain a preselected finish.

Accordingly, the principal object of the present invention is to provide apparatus for forming cold finished bar from hot rolled round in which a pair of work rolls are maintained in frictional engagement with the round to apply the required force upon the round to dislodge the scale and maintain rotation of the round as it advances linearly between the work rolls.

Another object of the present invention is to provide a process and apparatus for forming cold finished bar from hot rolled round in a continuous operation that includes a first stage of removing substantially all the scale from the surface of the round, a second stage where the remaining scale is removed from the round to form a bar, and a third stage where the bar is finished to a preselected size and surface smoothness.

Another object of the present invention in forming cold finished bar from hot rolled round is to combine in one operation the separate operations of removing mill scale from the surface of the round and reducing and sizing the round.

A further object of the present invention is to provide an improved process and apparatus for forming cold finished bar from hot rolled round that overcomes the disadvantages of commercially known methods such as acid pickling, cold rolling, cold drawing and the like.

These and other objects of the present invention will be more completely disclosed and described in the following specification, accompanying drawings and appended claims.

DESCRIPTION OF THE PREFERRED EMBODIMENT

Figure 1:
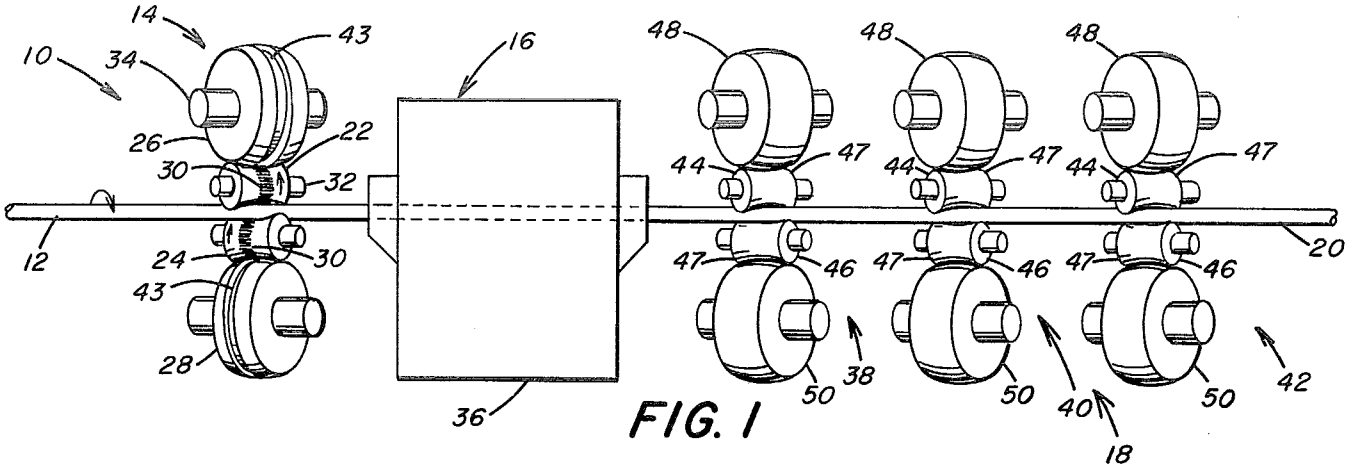
FIG. 1 is a schematic elevation of the process and apparatus for forming cold finished bar from hot rolled round, illustrating a bar which is initially passed through a cross-rolling unit for removing a substantial portion of the mill scale from the bar followed by feeding the bar through a descaling chamber where the remaining scale is removed from the bar followed by a series arrangement of cross-rolling units for making final reductions of the formed bar and finishing the bar to a preselected surface smoothness.

Referring to the drawings and particularly FIG. 1, there is illustrated an apparatus for forming cold finished bar from hot rolled round generally designated by the numeral 10. Initially hot rolled round stock 12 is fed through a primary scale remover 14 that engages the surface of the round stock 12 to dislodge between about 80% to 90% of the mill scale from the surface of the round stock. From the primary scale remover 14, the round stock 12 is fed in a second stage through a secondary scale remover 16 that is operable to remove the remaining scale from the surface of the round to form a bar free of mill scale. In a third stage, the bar is fed through a rolling mill generally designated by the numeral 18. The rolling mill reduces the bar to a final dimension and finishes the bar to a preselected surface smoothness to obtain a cold finished bar 20.

The hot rolled round stock 12 is fed longitudinally to the primary scale remover 14, which preferably is a cross-rolling unit or a single stand of rolls similar to that disclosed in the U.S. Pat. No. 2,642,763, entitled "Cross Rolling Mill", which is incorporated herein by reference. The stand of rolls of the primary scale remover 14 includes a pair of work rolls 22 and 24 which are supported by a pair of backing rolls 26 and 28 having a diameter substantially greater than the diameter of the work rolls. The body of each work roll is illustrated in greater detail in FIGS. 2 and 3 where only work roll 22 and backing roll 26 are illustrated.

Each work roll 22 has a concave surface 29. Intermediate each work roll on the concave surface 29 is a rugulose surface 30 that extends in an annular ring around the work roll. The rugulose surface 30 is a rough, abrading surface without sharp edges, as will be explained later in greater detail, in comparison with the entirely smooth surfaces of the work rolls disclosed in U.S. Pat. No. 2,642,763. With this arrangement, the work rolls frictionally engage the round to apply maximum rolling pressure to dislodge the scale from the round and to maintain the round rotating and prevent skidding of the round between the work rolls 22.

The axis of rotation of the rolls 22 and 24 are crossed and positioned at an angle to the axis of the round stock 12 to form a cylindrically-shaped roll pass on which the round stock travels. The rugulose surface 30 of each of the rolls 22 and 24 frictionally engages the surface of the round stock 12 to deform the surface thereof and to roughen the surface as illustrated by the spiral pattern in FIG. 2. Deforming the surface of the round stock in this manner removes substantially all of the mill scale, i.e., between 80% and 90% of the scale from the round stock. Thus, in the first stage of the forming process the primary scale remover 14 removes substantially all of the mill scale from the surface of the hot rolled round stock 12.

Figure 2:
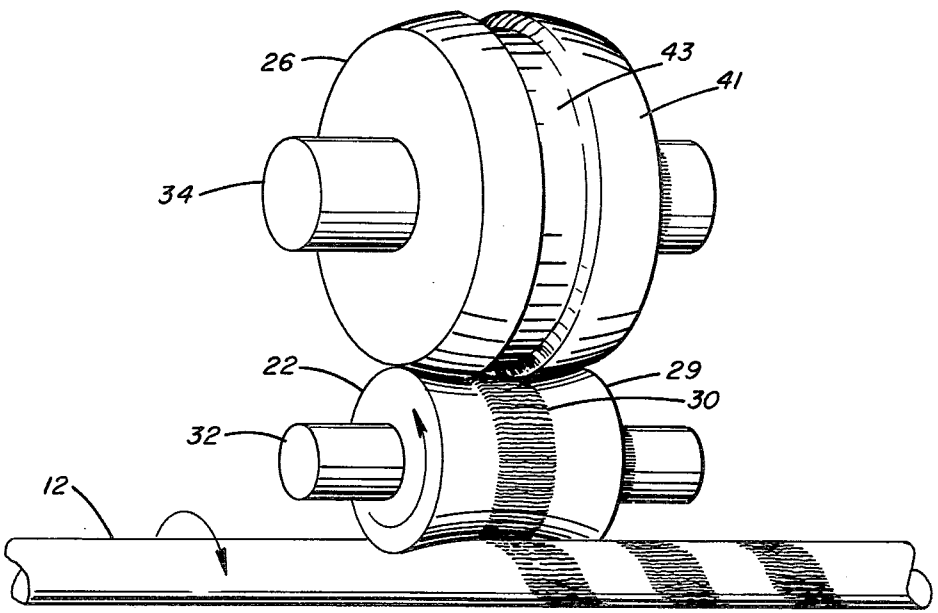
FIG. 2 is an enlarged fragmentary schematic of the cross-rolling unit of the first stage for removing the scale from the surface of the round, illustrating a work roll having a rough, rugulose surface for frictionally engaging the round to remove scale therefrom and a backing roll for maintaining pressure on the work roll to engage the round.

Each work roll 22 has a roll neck 32, that is operatively connected to a conventional mill drive. The work rolls 22 and 24 are driven in counter-rotating directions to impart both rotary and linear movement to the round stock 12. Thus, the surface of the round stock 12 is roughened or deformed in a spiral pattern by engagement with the abrading rugulose surface 30 of each roll 22 and 24. Specifically, the spiral pattern imparted to the round stock 12 by the work roll 22 is illustrated in FIG. 2. The spiral pattern on the surface of the round stock indicates the removal of the mill scale from the surface of the stock as accomplished by work roll 22. The other work roll 24 of the primary scale remover 14 dislodges also in a spiral pattern the scale from the round stock not contacted by the work roll 22 to substantially complete the removal of scale from the surface of the stock.

The hot rolled round is generally oval or semi-round in cross section. For work rolls having a smooth work engaging surface, the round follows the path of least resistance through the roll pass formed by the work rolls. Consequently, the round skids through the pass without rotating and the mill scale is not removed. However, with work rolls of the present invention having the rough rugulose or wrinkled surface 30 free of sharp edges, a rack and pinion effect is achieved between the work rolls 22 and 24 and the round stock to produce combined rotation and linear advancement of the round. Thus, the round follows a spiral course to ensure that substantially all the mill scale is removed from the surface of the round in the first stage of the process. Accordingly, the work roll 24 acts upon the remaining portion of the round stock to roughen the surface untouched by the work roll 22 in a spiral pattern corresponding to the spiral pattern developed by work roll 22.

Figure 4:
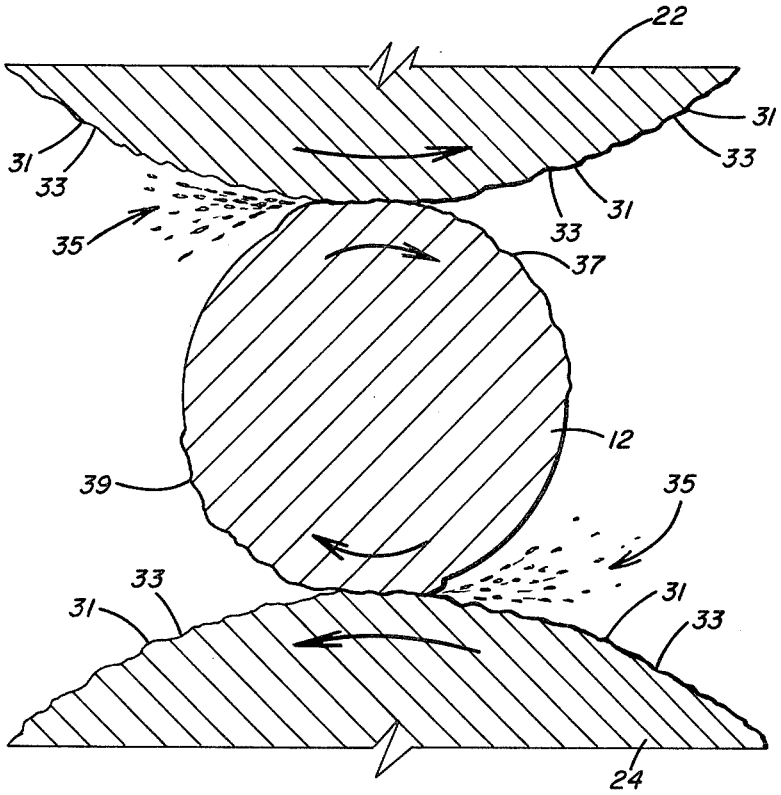
FIG. 4 is an enlarged fragmentary schematic view of the rugulose portions on the surfaces of the work rolls engaging the round, illustrating deformation of the round by the rugulose portions to dislodge scale from the round.

The surface roughness of the rugulose surfaces 30 of the work rolls 22 is illustrated schematically in FIG. 4. In FIG. 4 for purposes of illustration only the longitudinal axis of the round 12 is positioned parallel to the longitudinal axis of the roll neck 32; however, it should be understood in practice that round 12 is turned to an acute angle relative to the roll neck 32 as illustrated in FIG. 2. The rugulose surfaces 30 are formed by conventional machining operations on the concave surfaces 29 of the work rolls 22 and 24. Each surface 30 is continuous around the respective work roll and has a preselected width as shown in FIG. 2. The rugulose surface 30 has a finely wrinkled appearance formed by a plurality of ridges 31 separated by valleys 33 where the ridges and valleys are substantially rounded or arcuate in shape so as to form a corruagated surface and not to form sharp edges on the surface of the respective work roll.

With this arrangement, the rugulose surfaces 30 of the work rolls 22 and 24 frictionally engage the surface of the round 12. The area of contact of the work rolls 22 and 24 is thus substantially increased by the provision of the rugulose surfaces 30. Increasing the area of contact of the work rolls with the round increases the pressure applied by the work rolls upon the round. The pressure applied to the round through the rugulose surfaces 30 deforms the round as illustrated in FIG. 4 to remove the scale generally indicated by the numeral 35 as the rolls come in contact with the round. The abrading affect achieved by the rugulose surface upon the round roughens the round as indicated by the rugulose surfaces 37 and 39 on the round.

As illustrated in FIG. 4, the work rolls 22 and 24 rotate in opposite directions. With the rugulose surfaces 30 frictionally engaging the round, the work rolls transmit rotation to the round. This arrangement is similar to a drive gear operation where the rotating work rolls 22 and 24 engage the round 12 to transmit rotation to the round. Subsequently, as the round advances linearly between the roll pass formed by the work rolls 22 and 24, the round rotates so that it advances longitudinally along a spiral course. Thus, the entire surface of the round is engaged by the rugulose surfaces 30 and substantially all the scale is dislodged by the surface of the round 12 as it passes through the primary scale remover 14. The high rolling pressure applied to the round by this arrangement maintains rotation of the round through the roll pass and prevents skidding of the round through the roll pass. This assures maximum scale removal by the work rolls 22 and 24.

The work rolls 22 and 24 are too small in diameter to be self-supporting under the pressure required to apply sufficient pressure to the hot rolled round to deform the semi-round shape and dislodge the mill scale. Thus, the backing rolls 26 and 28 each having a diameter substantially greater than that of the work rolls support the work rolls so that they may withstand the rolling pressures encountered. Each backing roll is mounted on an arbor 34 and is arranged to rotate about the arbor 34 on roller bearings (not shown). Further, as disclosed in the above identified patent, the work rolls 22 and 24 and the backing rolls 26 and 28 are adjustable both vertically and rotationally as a unit. This feature permits each work roll to be maintained in alignment with its respective backing roll so the angle a work roll makes with the round stock and the size of the roll pass through which the round stock advances can be adjusted.

Figure 3:
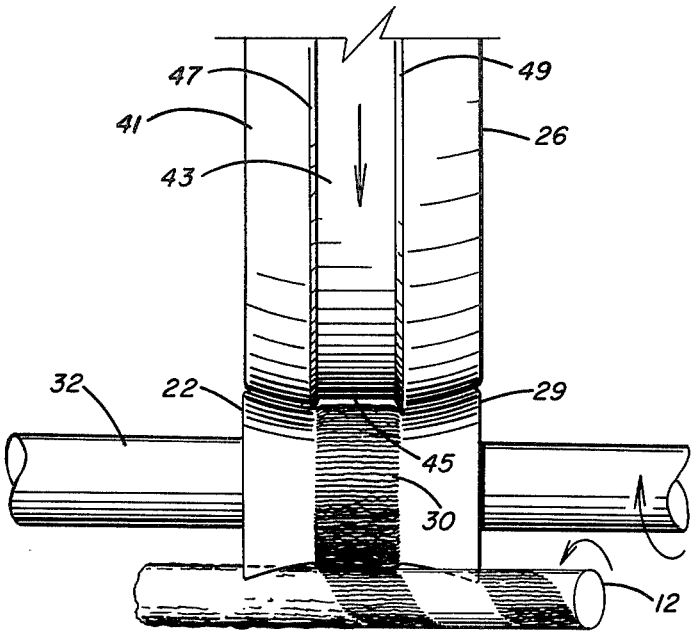
FIG. 3 is a view similar to FIG. 2, illustrating the surface of the backing roll formed with an annular relief portion recessed from the surface of the backing roll to remove the surface of the backing roll opposite the rugulose surface of the work roll from contact with the rugulose surface.

As illustrated in FIGS. 1–3 each of the backing rolls 26 and 28 has a smooth convex surface 41 cooperating with the concave surfaces 29 of the work rolls 22 and 24 respectively. Intermediate the surface 29 of each backing roll is provided an annular relief portion 43 which is recessed from the surface 41. The relief portion 43 is positioned oppositely of the rugulose surface 30 of the respective work roll. The width of the relief portion 43 is preferably slightly greater than the width of the rugulose surface 30. With this arrangement, the rugulose surface 30 is removed from contact with the surface of the backing roll, but the smooth surfaces 29 and 41 of the work roll and backing roll respectively remain in abutting relation.

The backing rolls 26 and 28 are removed from contact with the rough rugulose surfaces 30 of the work rolls 22 and 24 by the provision of the relief portions 43. In this manner wearing of the rough rugulose surfaces 30 by contact with the backing rolls 26 and 28 to form smooth surfaces is prevented. The abrading action of the rugulose surfaces 30 on the round is thus maintained to provide the high percentage of scale removal accomplished by the primary scale remover 14.

The relief portions 43 are conventionally machined on the backing rolls 26 and 28. As illustrated in FIGS. 2 and 3, the relief portions 43 include a flat 45 of the desired width with arcuate sidewalls 47 and 49 extending upwardly from the flat 45 to the convex surface 41. It will be apparent that the relief portions 43 may be constructed of any configuration, as for example instead of a flat 45, a concave surface or a groove may be provided so that regardless of the specific configuration of the relief portions 43, the backing rolls 26 and 28 are removed from contact with the rugulose surfaces 30 but are in contact with the smooth concave surfaces 29 of the work rolls 22 and 24.

The rolling pressure of the backing rolls 26 and 28 is transmitted to the work rolls 22 and 24 and therefrom to the round stock 12. Thus, the round stock 12 is rotated as it advances linearly from the primary scale remover 14 to the secondary scale remover 16. Secondary scale remover 16 is operable to dislodge the remaining mill scale from the surface of the round stock to form a bar free of scale as it proceeds to the rolling mill 18 for the finishing operation. The secondary scale remover is a conventional descaling machine well known in the art. A commercially available descaling machine suitable for use in the present invention is a descaling machine manufactured by Pangburn Corp. under the trademark "Rotoblast" and described in Bulletin No. 609 entitled "Pangburn Rotoblast Descaling Machines".

Basically, the descaling machine that comprises the secondary scale remover 16 includes a sealed cabinet 36 forming a chamber in which a plurality of blast units are selectively positioned. Each of the blast units has an outlet from which a stream of abrasive particles such as shot and/or grit is directed under pressure upon the surface of the round stock. The abrasive stream dislodges the remaining mill scale from the round. The blast units are positioned within the chamber to ensure that the entire surface area of the round is covered by the abrasive streams. In the second stage the remaining mill scale is removed from the stock to form a bar free of scale.

The round 12 is advanced in a spiral course through the secondary scale remover as a result of the motion imparted to the round by the work rolls 22 and 24. The spiral advance of the round through the secondary scale remover 16 provides for uniform descaling of the round. The round advances from the secondary scale remover in a spiral course to the rolling mill 18 for final finishing of the bar in the third stage of the forming process. In the third stage a multiple stand of cross-rolling units 38, 40 and 42 are positioned in a series arrangement for performing final reduction and sizing of the bar and finishing the surface of the bar to a preselected surface smoothness. Each rolling unit includes a pair of work rolls 44 and 46 having a smooth concave work-engaging surface 47 unlike the rugulose surfaces 30 of the work rolls 22 and 24. The work rolls 44 and 46 are supported by backing rolls 48 and 50. The backing rolls 48 and 50 have a diameter substantially greater than the diameter of the corresponding work rolls 44 and 46.

The backing rolls 48 and 50 are operable to transmit a rolling pressure to the work rolls 44 and 46 which transfer the rolling pressure to the bar 20. The roll pressures transmitted by the work rolls 44 and 46 to the bar 20 are of sufficient pressure to perform a final reduction in the diameter of the bar. The cross-rolling units of the third stage also combine to finish the bar to a preselected surface finish. Thus, following the third stage of the forming process all the mill scale and other surface contaminates are removed from the surface of the bar so that the bar is ready for coating or inspection for surface defects.

It will be apparent from the present invention that the combination of the cross-rolling unit as a primary scale remover and the descaling machine as a secondary scale remover provides for an efficient descaling operation that not only increases the production rate but also eliminates a substantial number of other conventionally known descaling operations to provide a round bar substantially free of scale. In addition, the rolling units of the finishing stage are operable to exert upon the formed bar rolling pressures that reduce the diameter of the bar to a final dimension with the surface of the bar finished to a quality that permits coating of the bar without the need for further surface treating. Accordingly, it will be apparent that in the third or finishing stage, roll pressures are applied to the bar at a preselected magnitude to provide the desired surface smoothness. In this manner the workpiece is efficiently descaled and reduced in one process.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. Apparatus for forming cold finished bar from hot rolled round comprising, a primary scale remover for receiving the hot rolled round, said primary scale remover including a cross-rolling unit having a first rotating means for frictionally engaging the surface of the round and a second rotating means for supporting said first rotating means to exert sufficient pressure on the round to deform the round and thereby remove a substantial portion of the scale from the surface of the round, said first rotating means including a pair of work rolls each having a concave surface, a rugulose surface extending in an annular ring around said each work roll on said concave surface intermediate said work roll, said rugulose surface being formed by a rough abrading surface free of sharp edges and thereby adapted to frictionally engage the round, said rugulose surface being operable to apply maximum rolling pressure to dislodge the scale from the round and to impart rotary motion to the round so that the round rotates along a spiral path as the round advances linearly through said primary scale remover, said second rotating means including a pair of backing rolls each having a convex surface positioned in abutting relation with said concave surface of said respective work roll, said backing rolls each having a relief portion positioned oppositely of said respective rugulose surface, said relief portion being recessed a preselected depth from said backing roll convex surface and extending around said backing roll to form a surface having a width greater than the width of said rugulose surface, and a pair of sidewalls extending upwardly from said recessed surface to said convex surface to thereby remove said backing roll convex surface from contact with said rugulose surface and maintain contact of said backing roll convex surface with said work roll concave surface.

2. Apparatus for forming cold finished bar from hot rolled round as set forth in claim 1 which includes, said first rotating means and said second rotating means having cooperating surfaces maintained in abutting relation to thereby transmit rolling pressure from said second rotating means to said first rotating means and therefrom through said rugulose surface to the surface of the round.

3. Apparatus for forming cold finished bar as set forth in claim 1 which includes, said first and second rotating means having cooperating surfaces positioned in abutting relation to facilitate the transfer of rolling pressure from said second rotating means to said first rotating means and therefrom to the round, and said relief portion being removed from contact with said rugulose surface so that said rugulose surface is prevented from wearing smooth by contact with said second rotating means.

4. Apparatus for forming cold finished bar from hot rolled round as set forth in claim 1 which includes, said rugulose surface annular ring being formed by a plurality of arcuately shaped ridges and valleys to generate a rough surface for frictionally engaging the surface of the round to apply maximum rolling pressure upon the round for removing substantially all the mill scale from the surface of the round.

5. Apparatus for forming cold finished bar from hot rolled round as set forth in claim 1 in which, said backing roll relief portions being positioned oppositely of and removed from contact with said work roll rugulose surfaces respectively to prevent a reduction in the roughness of said rugulose surfaces by wear contact with said backing rolls, and said rugulose surfaces being operable to transmit rotation to the round for advancing the round longitudinally along a spiral course.

6. Apparatus for forming cold finished bar from hot rolled round as set forth in claim 1 which includes, a secondary scale remover positioned adjacent to said primary scale remover, said secondary scale remover including a descaling chamber having means for applying a plurality of abrasive particulate streams upon the surface of the round, and said means for applying abrasive particulate streams being operable to cover the entire surface of the round with a stream of abrasive particles under pressure to uniformly remove the remaining scale from the surface of the round and form a bar free of scale.

7. Apparatus for forming cold finished bar from hot rolled round as set forth in claim 6 which includes, finishing means positioned adjacent to said secondary scale remover for receiving the bar to treat the surface of the bar to obtain a finished bar having a preselected size and surface quality, said finishing means includes a plurality of cross-rolling units positioned in a series arrangement, said cross-rolling units each having a pair of work rolls and a pair of backing rolls respectively, said backing rolls being rotatably supported to apply a preselected pressure upon said work rolls, and said work rolls each having a work engaging surface maintained in contact with the bar for reducing the bar to a preselected size and for treating the surface of the bar to obtain a preselected surface quality.

8. Process for forming cold finished bar from a hot rolled round comprising, feeding the hot rolled round in a first stage through a primary scale remover, imparting rotary and linear movement to the hot rolled round in the first stage by contact of the hot rolled round with a rotating rugulose surface positioned on the surface of a first rotating means to thereby advance the hot rolled round longitudinally along a spiral course, engaging the surface of the round by the rotating rugulose surface to obtain the maximum application of pressure per unit area upon the surface of the round, supporting the first rotating means by a second rotating means, applying maximum rolling pressure upon the first rotating means by the second rotating means to maintain the rugulose surface in engagement with the surface of the round, maintaining a portion of the second rotating means removed from contact with the rugulose surface to prevent reducing the roughness of the rugulose surface and maintain the abrading effect of the rugulose surface on the round, deforming the cross section of the round by the application of pressure thereto by the primary scale remover to thereby remove in the first stage a substantial portion of the scale from the surface of the round, feeding the hot rolled round in a second stage through a secondary scale remover, removing the remaining scale from the surface of the round in the secondary scale remover to form a bar free of scale, feeding the bar in a third stage through a means for finishing the bar, and finishing the surface of the bar in the third stage to obtain a cold finished bar having a preselected size and surface quality.

9. Process for forming cold finished bar from hot rolled round as set forth in claim 8 which includes, deforming the surface of the hot rolled round in said first stage by application of pressure to the round through the rugulose surface, transmitting drive to the round by engagement therewith by the rugulose surface, and thereafter advancing the round longitudinally along a spiral path as the scale is removed from the surface of the round.

10. Process for forming cold finished bar from hot rolled round as set forth in claim 8 which includes, feeding the hot rolled round linearly along a spiral path at a preselected rate in said first stage by contact with the rugulose surfaces of a first pair of rolls of a cross-rolling unit, positioning the first pair of rolls in contact with the surface of the round by a second pair of rolls of said cross-rolling unit to thereby urge the rugulose surfaces into frictional engagement with the surface of the round to apply pressure to the round to dislodge and remove between about 80% to 90% of the scale from the surface of the round, and maintaining the surfaces of the second pair of rolls removed from contact with the rugulose surfaces to prevent a reduction in the roughness of the rugulose surfaces by wear contact with the second pair of rolls.

* * * * *